US006982641B1

(12) United States Patent
Greene

(10) Patent No.: US 6,982,641 B1
(45) Date of Patent: Jan. 3, 2006

(54) SIMPLIFIED CIRCUIT FOR INTRUSION DETECTORS

(75) Inventor: Michael L. Greene, Fort Washington, MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 128 days.

(21) Appl. No.: 10/807,579

(22) Filed: Mar. 18, 2004

(51) Int. Cl.
*G08B 13/00* (2006.01)

(52) U.S. Cl. ..... 340/541; 340/506; 340/508; 307/116

(58) Field of Classification Search ..... 340/541, 340/506, 505, 508, 531, 693.1, 565, 571, 340/636.12, 636.13, 636.17; 307/112, 116
See application file for complete search history.

(56) References Cited

U.S. PATENT DOCUMENTS 4,468,658 A * 8/1984 Rossin ..... 340/567
4,605,922 A * 8/1986 Blattman et al. ..... 340/552

* cited by examiner

*Primary Examiner*—Jeffery Hofsass
*Assistant Examiner*—Daniel Previl
(74) *Attorney, Agent, or Firm*—Fredric J. Zimmerman

(57) ABSTRACT

The present invention comprises a simplified control/hook-up circuit for intrusion detection devices that reduces the overall number of wires and attendant connections necessary between the control panel box and the terminals of the detector. This simplified design operates as efficiently as present intrusion device designs, while decreasing device hook-up time for field technicians and providing less opportunity for user error.

14 Claims, 3 Drawing Sheets

SIMPLIFIED CIRCUIT FOR INTRUSION DETECTORS

STATEMENT OF GOVERNMENT INTEREST

The invention described herein may be manufactured and used by or for the Government of the United States of America for governmental purposes without payment of any royalties thereon or therefor.

BACKGROUND OF THE INVENTION

1. Field of the Invention

The present invention pertains to improved intrusion detectors, more particularly to improved circuit designs for intrusion detectors, and most particularly to simplified circuit designs for intrusion detectors.

2. Description of the Related Art

Current intrusion or motion detectors, such as passive infrared detectors, have seven terminals that are for use in connection via a maximum of six wires to the control panel box. In general two terminals are used to power the device (the power and ground terminals), two terminals are used for a tamper switch (to assure the integrity of the case of the detector during the time the alarm is not in use), and a choice of two of three terminals are used for the alarm function of the device when an intrusion is detected (a normally closed (NC), normally open (NO) and common (C) type circuit). In this configuration, two wires are normally required to be connected to the power terminals, two wires are normally required to be connected to the tamper terminals, and two wires are normally required to be connected to the alarm terminals.

While, in operation, this control circuit configuration operates efficiently, it becomes cumbersome for field technicians to attach this large number of wires within the device. It also increases the opportunity to connect wires in an incorrect configuration, thereby rendering the device inoperable. Finally, in a manufacturing environment, it is costly to manufacture a product with this number of connections to a control panel box.

Therefore, it is desired to provide a simplified circuit design for intrusion detection devices that reduces the number of connections required for the devices to operate correctly.

SUMMARY OF THE INVENTION

The present invention comprises a simplified control/hook-up circuit for intrusion detection devices that reduces the overall number of wires and attendant connections necessary between the control panel box and the terminals of the detector. This simplified design operates as efficiently present intrusion device designs, while decreasing device hook-up time for field technicians and providing less opportunity for user error.

Accordingly, it is an object of this invention to provide a simplified control/hook-up circuit for intrusion detection devices.

It is a further object of this invention to provide a simplified two wire control/hook-up circuit for intrusion detection devices to: allow the tamper switch within the intrusion detection device to be functional or indicate if the hook-up circuit is open; allow functioning of alarm status to the control panel box or show shorting of the hook-up circuit; allow easy optoelectronic coupling of tamper or firing status to the existing control panel box terminals; and allow pre-wiring the control panel box and intrusion device to effect two wire hook-up in the field.

This invention accomplishes these objectives and other needs related to simplified control circuits for intrusion detection devices by providing a simplified control circuit for an intrusion detection device. The intrusion detection device includes an intrusion detection alarm comprising a normally closed terminal, a normally open terminal, and a common terminal. The device further includes a power terminal and a ground terminal. Optionally, the device includes a tamper switch made up of a two terminal circuit.

The simplified circuit comprises the ground terminal connected to the common terminal. A direct current supply is included that provides sufficient power for the device in both a standby state and an active state. A positive terminal of the direct current supply is connected via a first return line to the power terminal. A negative terminal of the direct current supply is connected via a second return line to the normally open terminal. A first resistor is placed between the normally open terminal and the normally closed terminal and a second resistor is connected in the second return line so that current passes through the first and second resistor when the intrusion detection alarm is in the standby state. The circuit also includes a zener diode, having a peak reverse voltage, and an LED placed in parallel with the second resistor.

The resistances of the first and second resistors, the voltage of the direct current supply, and the peak reverse voltage of the zener diode are all selected, in conjunction with the power requirements of the intrusion detection device, to operate in the following manner. When the device is in the standby state (no intrusion has been detected), the voltage drop across the second resistor is insufficient for the zener diode to reach its peak reverse voltage. However, when the device is in the active state (an intrusion has been detected), removal of the first resistor from the circuit reduces the voltage drop across the intrusion detection alarm and increases the voltage drop across the second resistor to allow the peak reverse voltage of the zener diode to be exceeded. This added voltage allows the zener diode to conduct, activating the LED.

In a preferred embodiment of the invention, the circuit includes an on/off switch placed between the negative terminal and the power supply. A third resistor, one to limit current, and a second LED are placed in series with the direct current power supply so that when the switch is in the on position, power is supplied to the power terminal and the LED is activated. When the switch is in the off position, the LED comprises an inactive state and no power is supplied to the power terminal.

In a most preferred embodiment of the invention, the tamper switch terminals of the intrusion alarm are placed between the negative terminal and the power terminal. The circuit also includes: a series circuit comprising a third LED; a second zener diode having a second peak reverse voltage; and a fourth resistor in parallel with the intrusion detector and its first resistor. This series circuit is in parallel with the intrusion detector and its first resistor. In this configuration, when the tamper switch to the tamper switch terminal is broken/opened or the circuit is broken, the voltage across the second zener diode increases and exceeds the second peak reverse voltage, and, in turn, allows the second zener diode to conduct and operate (turn on) the third LED.

BRIEF DESCRIPTION OF THE DRAWINGS

The accompanying drawings, which are incorporated in and constitute a part of the specification, illustrate embodiments of the invention, and, together with the description, serve to explain the principles of the invention.

DESCRIPTION OF THE PREFERRED EMBODIMENT

The invention, as embodied herein, comprises a simplified circuit for an intrusion detection device that reduces the overall connections required between the intrusion device terminals and the terminals of the control panel box.

This simplified circuit permits power wires, alarm wires, and tamper wires to be combined into a single pair of wires form many types of direct current intrusion detectors. The circuit permits visible confirmation of alarm status and/or tamper status of an intrusion detection device.

In general, the invention uses changes of resistance with attendant voltage change across resistors attached to the direct current power source resulting from alarm or tamper status changes in order to allow zener diodes to conduct and associated LED's to illuminate. Functioning of an LED is coupled with an optoelectronic circuit to the appropriate terminals of the control panel box to indicate an alarm or tamper/cut wires.

Figure 1:
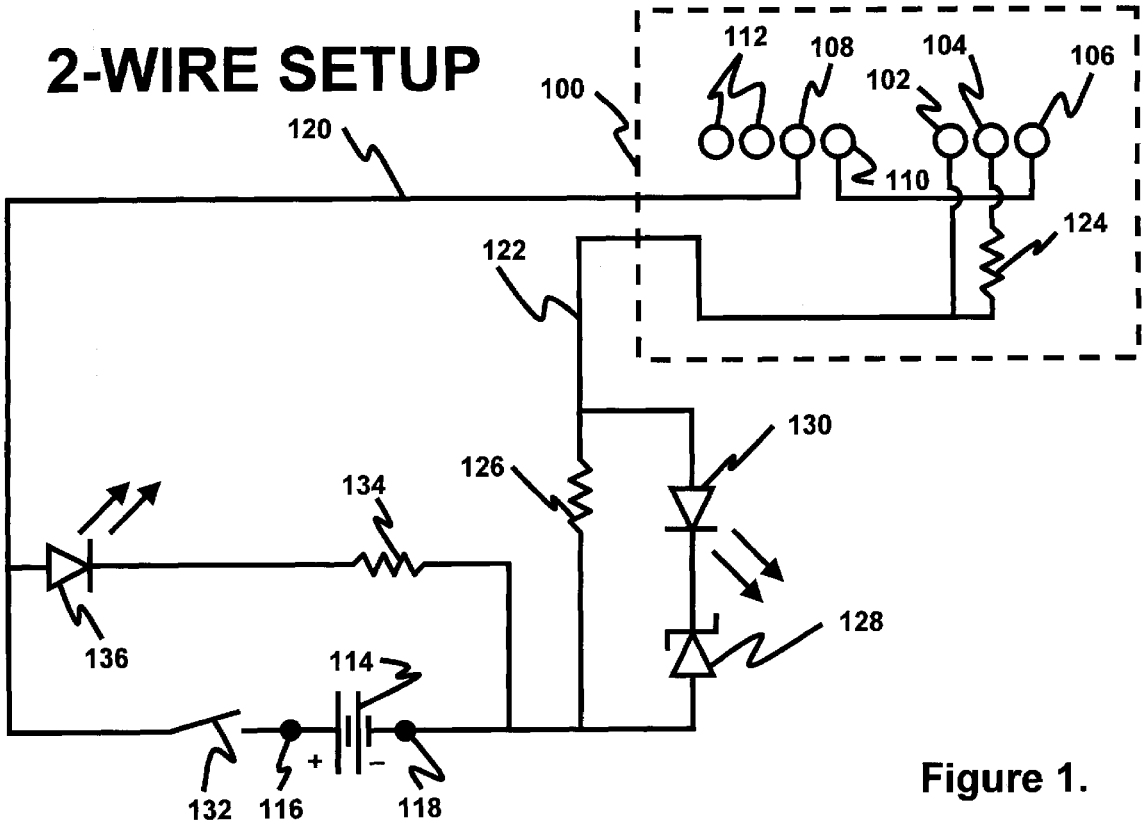
FIG. 1 shows an embodiment of the simplified circuit of the present invention that reduces the required connections of the circuit by 2.

Referring to FIG. 1, the device comprises an intrusion detection alarm 100 comprising normally open 102, normally closed 104, and common 106 terminals. To power the device, a power terminal 108 and ground terminal 110 are also included. An optional tamper switch 112, comprising a two terminal circuit may also be included. The improved circuit includes connecting the ground terminal to the common terminal. A direct current supply 114 having a first voltage sufficient to power the control circuit in standby and active states, is also included. In most configurations, the first voltage will be greater than the amount of power required to operate the device terminals described above. The direct current supply 114 also has positive 116 and negative 118 terminals.

The power terminal 108 is connected by a first return line 120 to the positive terminal 116 and the normally open terminal 102 is connected by a second return line 122 to the negative terminal 118. A first resistor 124, having a first resistance, is placed between the normally open terminal 102 and the normally closed terminal 104. A second resistor 126, having a second resistance, is placed within the second return line 122 so that current passes through the first 124 and second 126 resistors when the intrusion detection alarm 100 is in the standby state (the device is powered, but no intrusion has been detected).

A zener diode 128, having a peak reverse voltage, and an LED 130 are placed in series across the second resistor 126. In this configuration, when the device is in the standby state, a voltage drop across resistor 126 comprise insufficient voltage for the zener diode 128 to reach or exceed peak reverse voltage. Therefore, the zener diode 128 does not conduct and LED 130 is not illuminated/activated. When the device is in the active state (the device is powered and an intrusion has been detected), the first resistor 124 is removed from the circuit. This reduces the voltage drop across the intrusion detection alarm 100 and increases the voltage drop across the second resistor 126 to a voltage that will allow the peak reverse voltage to be exceeded. This allows the zener diode 128 to conduct and LED 130 to illuminate.

In a preferred embodiment of the invention, a switch 132, having on and off positions, is placed between the positive terminal 116 and the power terminal 108. A third resistor 134 that is current limiting and a second LED 136 are placed in series across the direct current power supply 114 so that when the switch 132 is in the on position, power is supplied to the power terminal 108 and second the LED 136 is activated. When the switch 132 is in the off position, the second LED 136 is not activated because no power is supplied to the power terminal 108.

While the values associated with the components mentioned above may be selected depending upon the power requirements of the intrusion detection device, the following are exemplary values for an intrusion detection device needing from about 9.5 volts to about 14.5 volts in order to operate. The direct current power supply 114 provides approximately 18 volts. As noted above, this voltage level is higher than the device needs to operate. The first resistor 124 comprises a resistance of approximately 47 ohms and the second resistor 126 comprises a resistance of approximately 487 ohms. The zener diode 128 comprises a peak reverse voltage of approximately 6.2 volts in order to conduct. In operation, during the standby state, these values would produce a voltage drop across the first 124 and second 126 resistors of about 7.5 volts. The remaining voltage drop of 10.5 volts would occur across the intrusion detection alarm 100 (falling within the required operating range of the device). The voltage drop across the second resistor 126 would be about 6.7 volts. Because the resistance of the LED 130, would provide greater than a 0.5 voltage drop, the zener diode 128 does not conduct (due to the required peak reverse voltage of 6.2 volts).

However, when the intrusion detection alarm 100 is in the active state, this removes the first resistor 124 from the circuit. The voltage drop across the intrusion detection alarm 100 is reduced to about 9.6 volts and the voltage drop across the second resistor 126 increases to about 8 volts. This increase in voltage is sufficient for the zener diode 128 to conduct and the associated LED 130 to illuminate.

Regarding the switch 132, to operate with the exemplary values described above, the third resistor 134 comprises a current limiting resistance of approximately 5.11 K ohms and the second LED 136.

Figure 2:
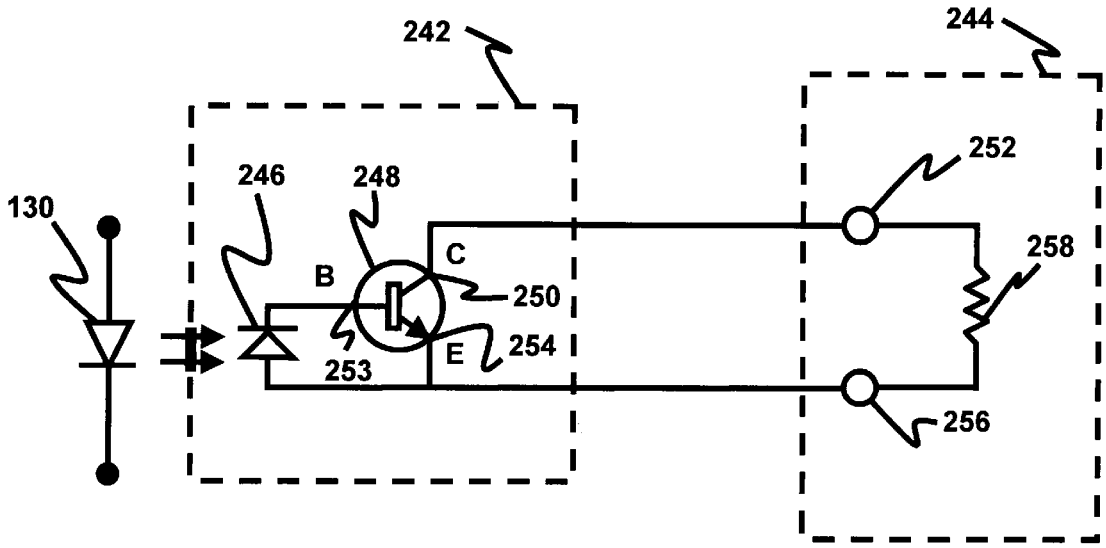
FIG. 2 shows an embodiment of the control panel box of the present invention.
Figure 3:
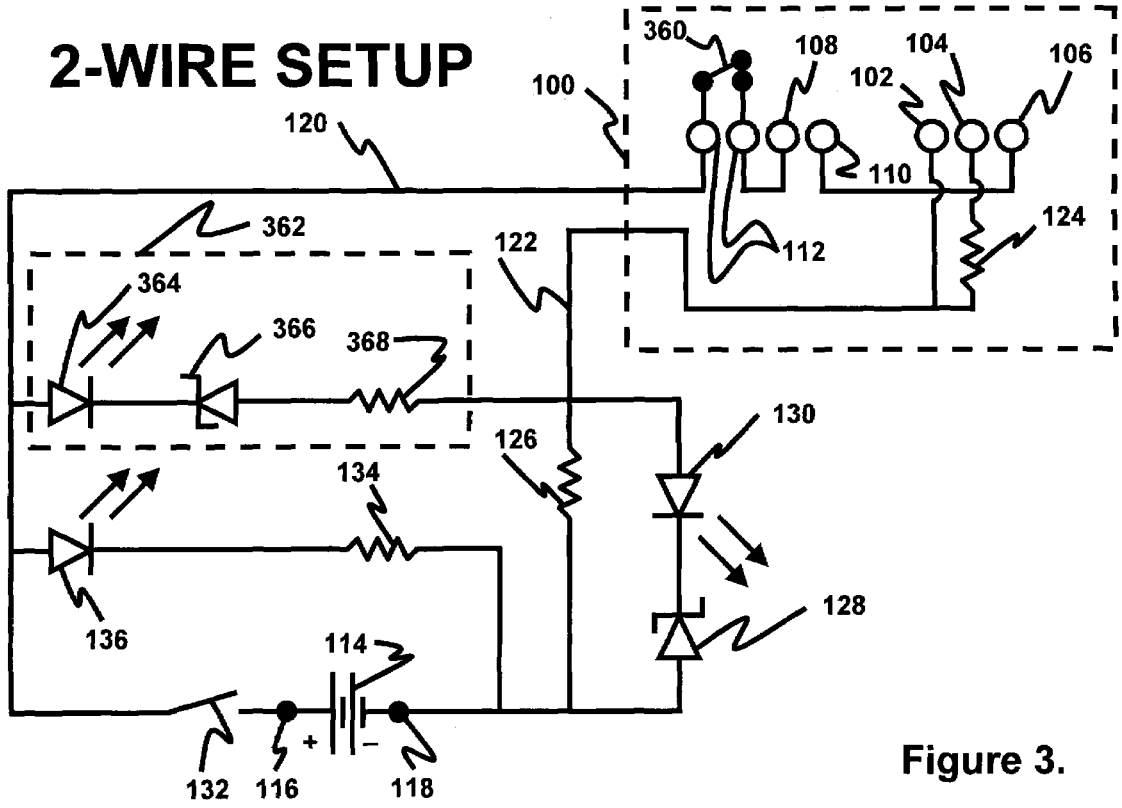
FIG. 3 shows an embodiment of the simplified circuit of the present invention that reduces the required connections of the circuit by 4.

Referring to FIGS. 2 and 3, LED 130, as an indicator of an intrusion, is coupled with an optoelectronic circuit 242 to the control panel box 244. A photodiode 246 is used to switch on a transistor 248. When photons illuminate the photodiode 246, a bias is provided to the base 253 of the transistor 248. This allows the transistor 248 to conduct. In most common devices, the transistor 248 comprises a NPN silicon transistor. The collector 250 of the transistor 248 is connected to any Z terminal 252 of the control panel box 244. An emitter 254 is connected to terminal 256. An end-of-line resistor 258 is connected across the circuit at the terminals 252, 256 in accordance with control panel box 244 manufacturer's instructions. Similar circuits and connection means may be used to couple third LED 364, as an indicator of tamper, to the control panel box 244.

The invention may also include a tamper switch 360, comprising a two terminal circuit 112 between the positive terminal 116 and the power terminal 108. Therefore, if the case of the device is removed or the wires to the intrusion detector are cut, this part of the circuit becomes open. Without the present invention, two additional wire connections would be necessary for the tamper switch to operate. Further circuitry for proper tamper switch operation include a series circuit 362 comprised of a third LED 364, a second zener diode 366 having a second peak reverse voltage, and a fourth resistor 368 across the first and second return lines. When the tamper switch 360 circuit is broken, the voltage increases across the second zener diode 366 increases to exceed the peak reverse voltage and allow the zerner diode to conduct the third LED 364 to illuminate.

Exemplary values for the circuit elements shown in FIG. 3 are as follows. The fourth resistor 368 comprises a resistance of approximately 220 ohms. The second peak reverse voltage comprises approximately 12 volts and the LED 364 comprises a voltage of approximately 2.1 volts.

The invention also includes a method of reducing the number of connections required between a circuit controller and associated terminals within an intrusion detection device as described above.

What is described are specific examples of many possible variations on the same invention and are not intended in a limiting sense. The claimed invention can be practiced using other variations not specifically described above.

What is claimed is:

1. A simplified control circuit for an intrusion detection device, comprising:

an intrusion detection alarm comprising a normally closed terminal, normally open terminal, and common terminal;

a ground terminal connected to the common terminal;

a direct current supply having a first voltage sufficient to power the control circuit in a standby and an active state, having positive and negative terminals;

a power terminal connected by a first return line to the positive terminal;

a first resistor, having a first resistance, placed between the normally open terminal and the normally closed terminal;

a second return line connected from the normally open terminal to the negative terminal;

a second resistor, having a second resistance, connected in the second return line, wherein current passes through the first and second resistor when the intrusion detection alarm comprises the standby state; and, a zener diode, having a peak reverse voltage, and in series with an LED that are both placed in parallel with the second resistor wherein a voltage drop across the second resistor comprises insufficient voltage to reach the peak reverse voltage in the standby state and wherein the active state removes the first resistor from the circuit, reduces the voltage drop across the intrusion detection alarm, and increases the voltage drop across the second resistor to result in a voltage over the peak reverse voltage across the zener diode that allows it to conduct and illuminate the LED.

2. The simplified control circuit of claim 1, wherein the first resistor comprises a resistance of approximately 47 ohms.

3. The simplified control circuit of claim 2, wherein the second resistor comprises a resistance of approximately 487 ohms.

4. The simplified control circuit of claim 3, wherein the direct current supply comprises a voltage of approximately 18 volts.

5. The simplified control circuit of claim 4, wherein the zener diode comprises a peak reverse voltage of approximately 6.2 volts.

6. The simplified control circuit of claim 5, wherein the intrusion detection alarm operates within a range of from about 9.5 volts to about 14.5 volts.

7. The simplified control circuit of claim 1, further comprising a switch between the positive terminal and the power terminal.

8. The simplified control circuit of claim 7, further comprising a third resistor, current limiting, and a second LED in series with the direct current power supply wherein when the switch comprises an on position, supplying power to the power terminal and activating the second LED, and wherein when the switch comprises an off position, the second LED comprises an inactive state and no power is supplied to the power terminal.

9. The simplified control circuit of claim 8, wherein the third resistor comprises a resistance of approximately 5.11 K ohms.

10. The simplified control circuit of claim 1, further comprising:

a tamper switch comprising a two terminal circuit between the positive terminal and the power terminal; and, a series circuit comprising a third LED, a second zener diode having a second peak reverse voltage, and a fourth resistor in series between the first and second return lines wherein breaking the tamper switch circuit increases the voltage across the series circuit to exceed the second peak reverse voltage to activate the second zener diode and the third LED.

11. The simplified control circuit of claim 10, wherein the fourth resistor comprises a resistance of approximately 220 ohms.

12. The simplified control circuit of claim 11, wherein the second peak reverse voltage comprises approximately 12 volts.

13. The simplified control circuit of claim 12, wherein the LED comprises a voltage of approximately 2.1 volts.

14. A method of reducing the connections in an intrusion detection device comprising a tamper switch having a two terminal circuit, a power terminal, a ground terminal, and an intrusion detection alarm having a normally closed terminal, a normally open terminal, and a common terminal, comprising the steps of:

connect the ground terminal to the common terminal;

provide a direct current supply having a first voltage sufficient to power the device in a standby and an active state, having positive and negative terminals;

provide a first return line through the tamper switch and between the power terminal and the positive terminal;

place a first resistor, having a first resistance, between the normally open terminal and the normally closed terminal;

provide a second return line connected from the normally open terminal to the negative terminal;

provide a second resistor, having a second resistance, connected in the second return line, wherein current passes through the first and second resistor when the intrusion detection alarm comprises the standby state;

provide a zener diode, having a peak reverse voltage, and an LED placed in series with the zener diode where both are in parallel with a second resistor wherein a voltage drop across the first and second resistors and across the intrusion detection alarm effect insufficient voltage to reach the peak reverse voltage of the zener diode in the standby state and wherein the active state removes the first resistor from the circuit, reduces the voltage drop across the intrusion detection alarm, and increases the voltage drop across the second resistor to effect a voltage to exceed the peak reverse voltage, activate the zener diode, and illuminate the LED; and, provide a series circuit comprising a third LED, a second zener diode having a second peak reverse voltage, and a fourth resistor that are all in parallel with the intrusion detection device and its first resistor wherein breaking the tamper switch circuit increases the voltage across the series circuit to exceed the second peak reverse voltage to activate the second zener diode and the third LED.

* * * * *